United States Patent [19]

Kaley

[11] Patent Number: 4,580,861

[45] Date of Patent: Apr. 8, 1986

[54] MODULAR CONNECTOR HOUSING STRIP

[75] Inventor: Robert C. Kaley, Landisville, Pa.

[73] Assignee: AMP Incorporated, Harrisburg, Pa.

[21] Appl. No.: 595,572

[22] Filed: Mar. 30, 1984

[51] Int. Cl.[4] ..... H01R 11/00

[52] U.S. Cl. ..... 339/59 R; 339/198 H

[58] Field of Search ..... 339/59 R, 59 M, 61 R, 339/61 M, 198 H

[56] References Cited

FOREIGN PATENT DOCUMENTS 649495 10/1964 Belgium ..... 339/198 G

*Primary Examiner*—Gil Weidenfeld
*Assistant Examiner*—Paula A. Austin
*Attorney, Agent, or Firm*—Robert W. J. Usher

[57] ABSTRACT

A strip of hermaphroditic modular connector housings (10) interlinked by complementary male and female links (14 and 15 respectively). The male link (14) comprising a head (27) joined to a housing wall (11') by a neck (28) and the female link (15) comprising a pair of resilient arms (16) extending in spaced relation from the side wall (11) with free ends (17) projecting towards each other to define a through socket (18). Stop shoulders (20–23) are provided at opposite axial ends of the through socket (18) offset on opposite sides of the socket axis past which stop shoulders (20–23) the head (27) can be forced to be received in the socket (18).

8 Claims, 8 Drawing Figures

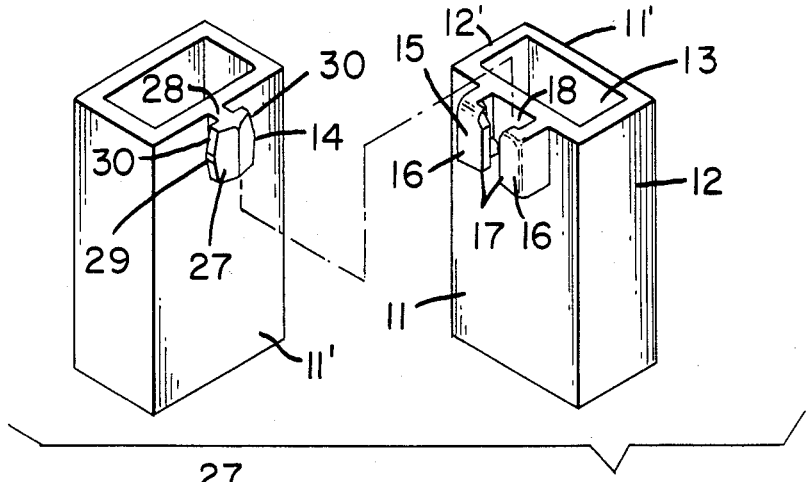
Fig. 1
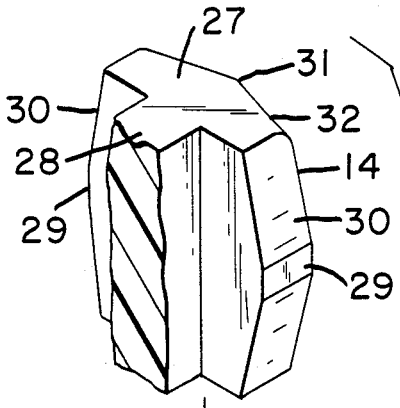
Fig. 2
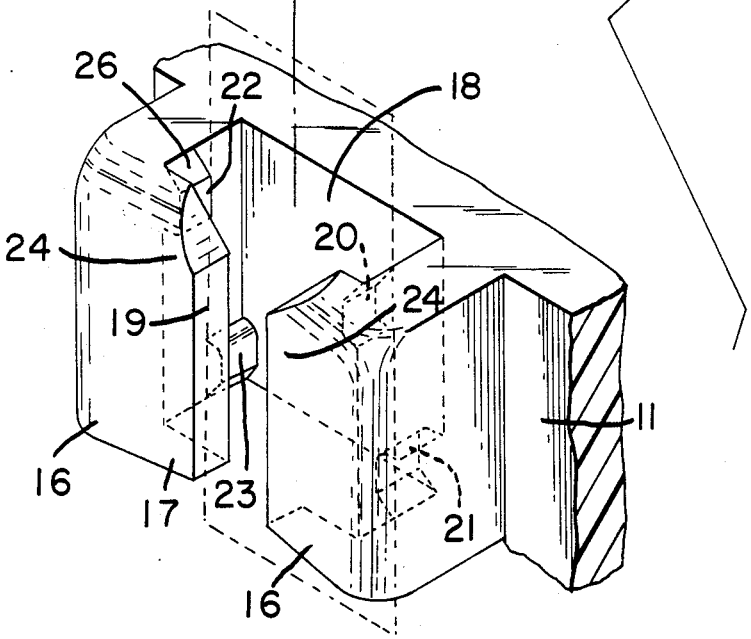

MODULAR CONNECTOR HOUSING STRIP

The invention relates to electrical connector housings and in particular to hermaphroditic modular connector housings which can be linked to identical connector housings to provide a strip of electrical connector housings.

As a result of the increasing need for automation and standardization of parts to enable rapid manufacture at low cost using mass production techniques and requiring a minimum inventory of different parts, there is a requirement for identical connector housing modules that can be linked together to provide either a composite connector housing of any desired length or a connector housing strip that can be fed through an assembly machine automatically inserting terminals into respective cavities.

In particular, it is desirable that such connector housings can be manufactured at minimum cost using simple straight draw moulding techniques, that the individual connector housings can be readily linked together to form the strip and released by movement in more than one direction, and that a limited degree of play in the strip be possible to enable the strip to be twisted about its longitudinal axis to enable insertion of terminals into the individual housing in different directions at different locations. At the same time it is also desirable that the pitch of the connector housings be kept constant when the strip is in straight condition to facilitate accurate automatic terminal insertion without a need for complex and expensive pitch adjusting mechanisms or the insertion tooling.

According to the invention there is provided a strip of hermaphroditic modular connector housings each moulded in one piece of plastic material and having spaced opposed side walls defining between them terminal receiving cavities and interlinked by complementary male and female links extending in opposite directions axially of the strip from opposite side walls of respective cavities, the female link comprising a pair of stiffly resilient arms extending in spaced relation from the side wall with free ends projecting towards each other to define a through socket with an access slot remote from the housing wall, a pair of stop shoulders at respective opposite axial ends of the socket and mutually offset on opposite sides of the socket axis, the male link comprising a head joined to the opposite side wall by a neck whereby the head can be forced past the stop shoulders into the through socket through either end with resilient deformation of the arms so that the head is releasably retained between the stop shoulders with the neck received in the slot.

Preferably the head is pivotable within the socket about the strip axis and formed with a portion eccentric of the strip axis to limit the pivotal movement whereby limited twist of the strip about its axis is permitted.

The offset of the stop shoulders enables the individual housings to be formed in a straight draw mould while the limited pivotal movement enables a strip of linked housings to be progressively twisted to present the terminal receiving cavities at different orientations when required. The versatility of the housings is further increased by the linking and unlinking being able to be accomplished by movement of the head into either end of the socket in either axial direction. The receipt of the head in the socket in a close fit as a result of the resiliency of the arms enables a very close pitch tolerance to be obtained.

More particularly, the socket axis and the cavity axis extend in the same direction and the eccentric portion is located adjacent respective opposite ends of the socket.

The head preferably tapers in a plane perpendicular to the strip axis from a central portion of maximum width towards the eccentric portion.

Desirably, the head has a central portion of maximum width as measured in the direction of the strip axis from which it tapers towards respective opposite edges as measured in a direction perpendicular to the cavity axis to enable limited relative pivotal movement of adjacent modules in directions perpendicular to the cavity and strip axes.

The surfaces of the free ends of the arms remote from the wall portion are inclined towards the wall portion as they extend towards each other to define a recess profiled to seat against the head.

This is important in enabling accurate orientation of loose piece modules in a vibratory hopper and feeding therefrom with maintenance of accurate centreline spacing enabling automatic assembly of successive modules together to form a strip without a need for complex centreline adjustment tooling.

The invention includes an individual modular connector housing.

An example of a strip of hermaphroditic modular connector housings according to the invention will now be described with reference to the accompanying drawings in which:

FIG. 1 is an exploded isometric view of a pair of connector housings of the strip;

FIG. 2 is an enlarged fragmentary isometric view of the linkage between the housings;

Figure 3:
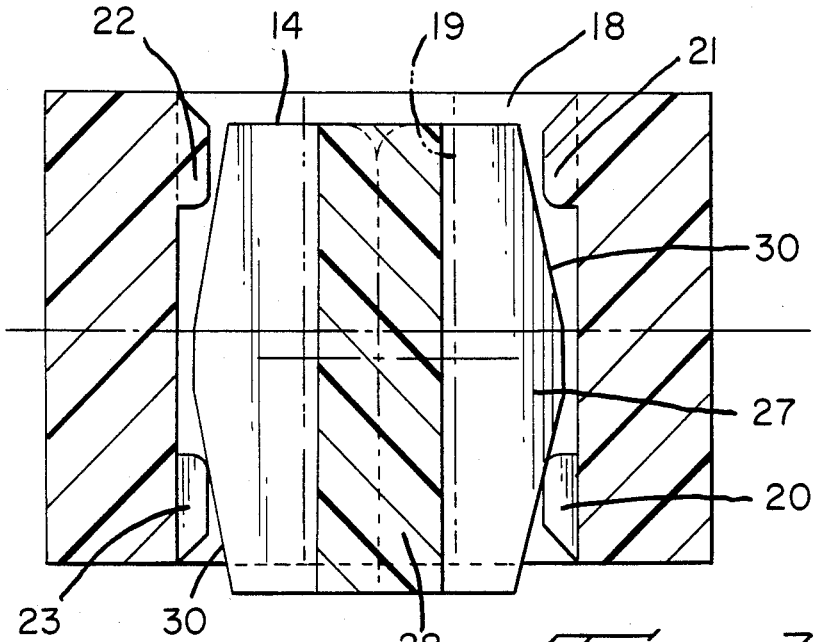
FIG. 3 is a cross-sectional view of linked aligned housings taken along lines 3—3 of FIG. 2.

The hermaphroditic modular connector housings 10 forming the strip are each molded in one piece of plastic material in generally rectangular cross-section with first and second pairs of spaced opposite side walls 11, 11' and 12, 12' defining between them an elongate terminal receiving cavity 13 open at a top. Complementary male and female links 14, 15 extend in opposite directions from first pairs of opposed side walls 11', 11 and are matable to link the modular housings together to form a housing strip having its longitudinal axis in the directions of extension of the links.

The female link 15 comprises a pair of stiffly resilient arms 16 extending from the side wall 11 in parallel relation, spaced apart in a direction perpendicular to the cavity and strip axes with free ends 17 of the arms extending towards each other to define a through-socket 18 with an access slot 19 remote from the housing wall 11. Surfaces 24 of the free ends of the arms remote from the wall 11 incline towards the wall 11 as they extend towards each other defining a V-section recess having its axis parallel to the cavity axis.

First and second pairs of stop shoulders 20, 21; 22, 23 are formed in the socket with the shoulders 20, 21 of the first pair laterally spaced apart in a direction perpendicular to the cavity and strip axes from the shoulders 22, 23 of the second pair. The stop shoulders 20, 22 and 21, 23 at respective opposite ends of the socket are offset on opposite sides of a medial plane indicated by broken lines in FIG. 2, enabling the stop shoulders and socket to be formed by a simple straight draw moulding procedure. Each stop shoulder has a canted lead-in surface 26.

Figure 6:
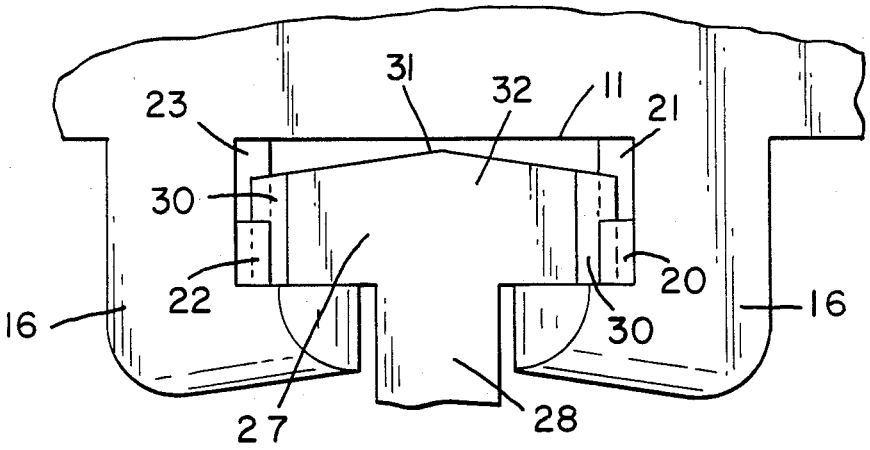
FIG. 6 is a fragmentary plan view of mated links.

The male link 14 comprises a head 27 joined to the side wall by a neck 28 to provide, in plan, a T-profile. The head has a central portion 29 of maximum width measured in a direction perpendicular to the socket and cavity axes and having surfaces 30 tapering towards respective opposite ends. The head is also formed with a central ridge 31 parallel to the socket axis and tapers towards its periphery as measured in the direction of the strip axis to provide inclined surfaces 32 as shown most clearly in FIGS. 2 and 6.

Thus the head may be considered to be of generally semi-ovate shape with a major axis parallel to the socket and cavity axes, the surfaces 30 being eccentric adjacent axial ends of the head.

Figure 4:
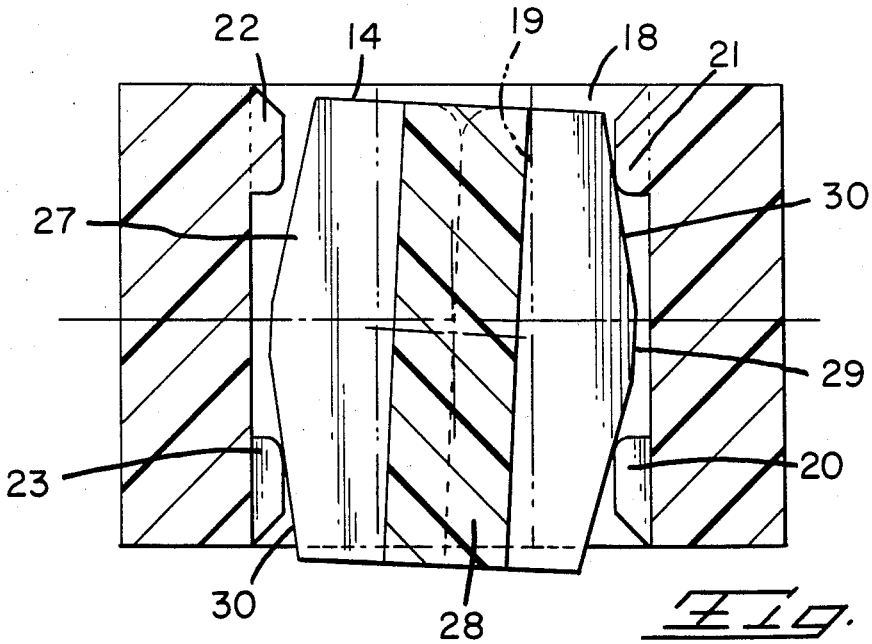
FIG. 4 is a cross-sectional view similar to FIG. 3 after relative pivotal movement of the housings to twist the strip.

As shown particularly in FIGS. 3 and 4, the head may be inserted into either end of the socket and received as a close fit in the socket by resilient deflection of the arms 16 permitting movement of the enlarged central portion 29 past the stop shoulders at either end of the socket. In the condition shown in FIG. 3, the surfaces 29 rest on the stop shoulders 23, 20 with the longitudinal axis of the head parallel to the socket axis. In this condition, a strip of modular housings will be aligned with their cavity axes extending in parallel relation.

Figure 5:
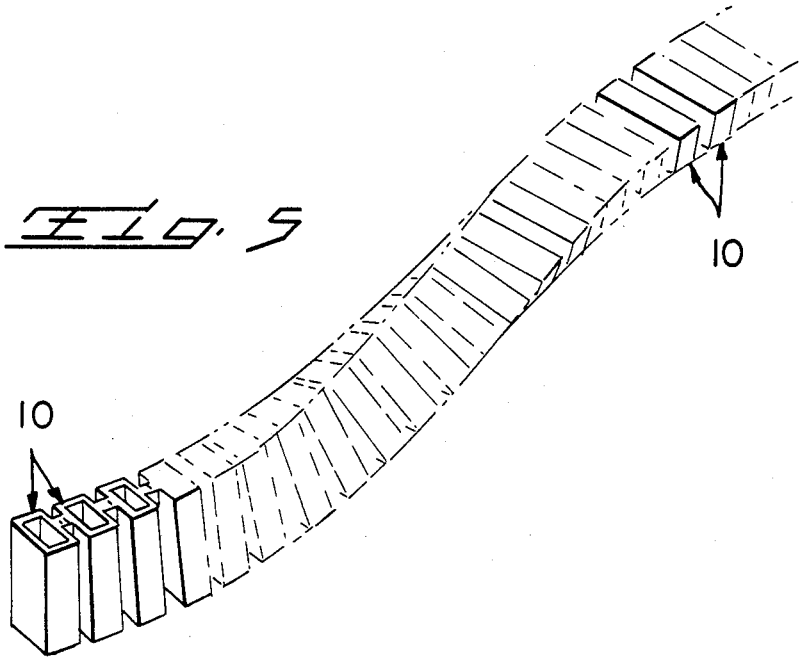
FIG. 5 is a isometric view of a twisted strip.

As a result of clearance between stop shoulders 20–24 and eccentric surface 29, limited pivotal rotation in a plane extending perpendicularly of the strip axis is possible until a diagonally opposed pair of eccentric surfaces 30 engage diagonally opposed stop shoulders, for example 21 and 23, preventing further rotation as shown in FIG. 4. This will enable the strip to be located in a twisted condition as shown in FIG. 5 so that the cavities can be located in any desired orientation (within limits) for terminal insertion or other operation.

The tapering of the head (in the axial direction of the strip) away from the ridge 31 enables adjacent modules to pivot to a limited extend in directions perpendicular both to the cavity and strip axis facilitating automatic feed.

Figure 7:
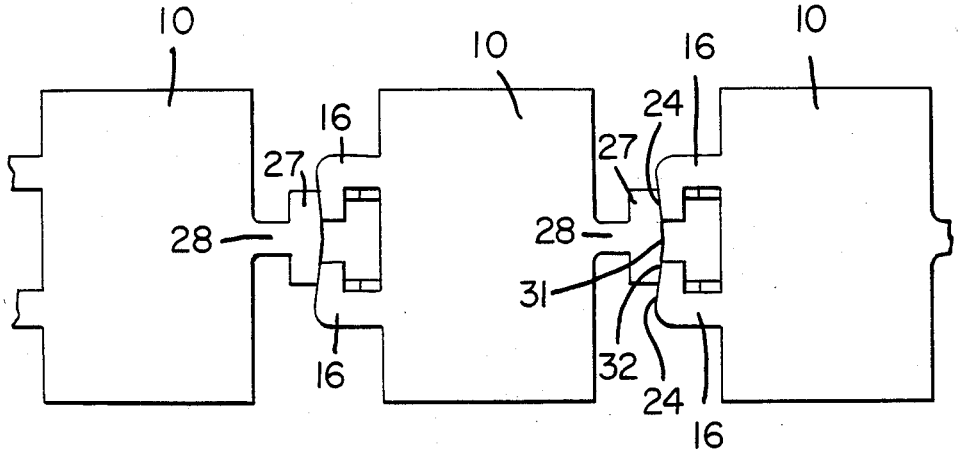
FIG. 7 is a schematic plan view of the linkage of adjacent connectors in loose piece condition.

As shown in FIG. 7, the surfaces 32 of the head seat against the surface 24 of the free ends of the socket arms when the modules are in loose piece condition enabling feed from a vibratory hopper with maintenance of precise pitch distance facilitating automatic assembly together to form the strip.

Figure 8:
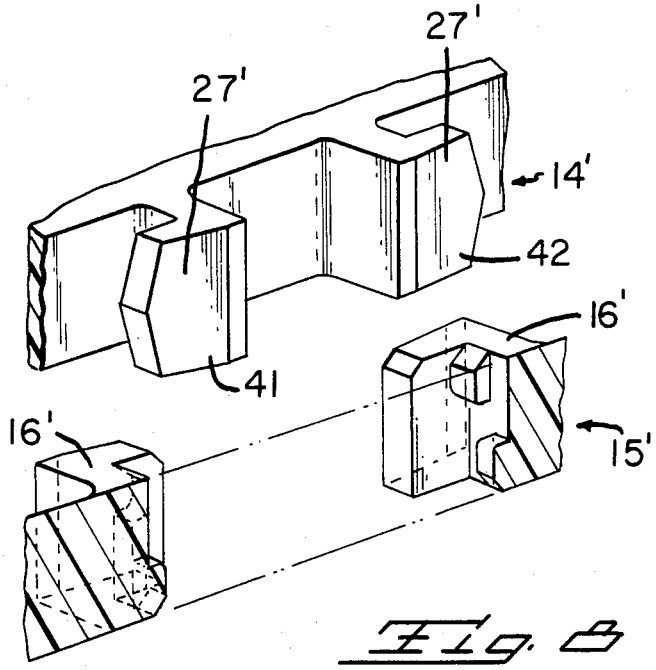
FIG. 8 is a fragmentary isometric view of alternative links in unmated condition.

The alternative example shown in FIG. 8 is similar to that described above except that the head 27' of the male link 14' is formed in two parts 41, 42 each resembling one half of the head 27 and being spaced apart in directions perpendicular to the strip and cavity axes. Arms 16' of the female link 15' also closely resemble those of the female link 16 described above providing a similar socket structure. This example may provide a more stable or rigid linkage than the above-described example.

I claim:

1. A strip of hermaphroditic modular connector housings each moulded in one piece of plastic material and having spaced opposed side walls defining between them terminal receiving cavities and interlinked by complementary male and female links extending in opposite directions axially of the strip from opposite side walls of respective cavities, the female link comprising a pair of stiffly resilient arms extending in spaced relation from the side wall with free ends projecting towards each other to define a through socket with an access slot remote from the housing wall, a pair of stop shoulders at respective opposite axial ends of the socket and mutually offset on opposite sides of the socket axis, the male link comprising a head joined to the opposite side wall by a neck, whereby the head can be forced past the stop shoulders into the through socket through either end with resilient deformation of the arms so that the head is releasably retained between the stop shoulders with the neck received in the slot, the head being pivotable within the socket about the strip axis and formed with a portion eccentric of the strip axis to limit the pivotal movement whereby limited twist of the strip about its axis is permitted.

2. A strip of hermaphroditic modular connector housings according to claim 1 in which the socket axis and the cavity axis extend in the same direction.

3. A strip of hermaphroditic modular connector housings according to claim 1 in which the eccentric portion is located adjacent respective opposite ends of the socket.

4. A strip of hermaphroditic modular connector housings according to claim 3 in which the head tapers in a plane perpendicular to the strip axis from a central portion of maximum width towards the eccentric portion.

5. A strip of hermaphroditic modular connector housings according to any one of the preceding claims in which the head has a central portion of maximum width as measured in the direction of the strip axis from which it tapers towards respective opposite edges as measured in a direction perpendicular to the cavity axis to enable limited relative pivotal movement of adjacent modules in directions perpendicular to the cavity and strip axes.

6. A strip of hermaphroditic modular connectors according to claim 4 in which an additional pair of stop shoulders is provided at respective opposite ends of the socket, the stop shoulders at common ends of the socket being spaced apart laterally in a plane direction perpendicular to the strip and cavity axes and the stop shoulders at one end of the socket being offset on opposite sides of the medial plane of the socket perpendicular to the strip axis from the stop shoulders at the other end of the socket.

7. A strip of hermaphroditic modular connectors according to claim 5 in which surfaces of the free ends of the arms remote from the wall portion are inclined towards the wall portion as they extend towards each other to define a recess profiled to seat against the head.

8. A strip of hermaphroditic modular connector housings each moulded in one piece of plastic material and having spaced opposed side walls defining between them terminal receiving cavities and interlinked by complementary male and female links extending in opposite directions axially of the strip from opposite side walls of respective cavities, the female link comprising a pair of stiffly resilient arms extending in spaced relation from the side wall with free ends projecting towards each other to define a through socket with an access slot remote from the housing wall, a pair of stop shoulders at respective opposite axial ends of the socket, the male link comprising a head joined to the opposite side wall by a neck, whereby the head can be forced past the stop shoulders into the through socket through either end with resilient deformation of the arms so that the head is releasably retained between the stop shoulders with the neck received in the slot, the head being pivotable within the socket about the strip axis and formed with a portion eccentric of the strip axis to limit the pivotal movement whereby limited twist of the strip about its axis is permitted.

* * * * *